US005681162A

United States Patent [19]

Nabors, Jr. et al.

[11] Patent Number: 5,681,162

[45] Date of Patent: Oct. 28, 1997

[54] LOW PRESSURE ATOMIZER

[76] Inventors: James K. Nabors, Jr., 311 Riverbend Blvd.; William C. Andrews, 510 Smokerise Blvd., both of Longwood, Fla. 32779

[21] Appl. No.: 702,196

[22] Filed: Sep. 23, 1996

[51] Int. Cl.[6] ..... F23D 14/48; F23D 14/62

[52] U.S. Cl. ..... 431/354; 431/8; 239/431; 239/424.5

[58] Field of Search ..... 431/354, 8, 9, 431/10, 285; 239/431, 405, 424.5, 426, 434, 417.3

[56] References Cited

U.S. PATENT DOCUMENTS

| | | | |
|---|---|---|---|
| 1,071,381 | 8/1913 | Anthony . | |
| 1,512,132 | 10/1924 | Pfahl . | |
| 2,149,980 | 3/1939 | Paret, Jr. | 263/15 |
| 2,599,422 | 6/1952 | Yettaw | 239/431 |
| 2,613,737 | 10/1952 | Schietert | 239/431 |
| 3,088,681 | 5/1963 | McCutcheon, Jr. | 431/285 |
| 4,378,205 | 3/1983 | Anderson | 431/15 |
| 4,439,137 | 3/1984 | Suzuki et al. | 431/8 |
| 4,475,885 | 10/1984 | Finke | 431/182 |
| 4,494,923 | 1/1985 | Guillaume et al. | 431/9 |
| 4,541,796 | 9/1985 | Anderson | 431/187 |
| 4,622,007 | 11/1986 | Gitman | 432/13 |
| 4,790,743 | 12/1988 | Leikert et al. | 431/8 |
| 4,842,509 | 6/1989 | Hasenack | 431/10 |
| 4,933,163 | 6/1990 | Fischer et al. | 423/574 |
| 4,954,076 | 9/1990 | Fioravanti et al. | 431/116 |
| 4,957,050 | 9/1990 | Ho | 110/346 |
| 4,988,285 | 1/1991 | Delano | 431/5 |
| 4,997,362 | 3/1991 | Hebel | 431/177 |
| 5,044,558 | 9/1991 | Young et al. | 239/391 |
| 5,267,850 | 12/1993 | Kobayashi et al. | 431/8 |
| 5,302,112 | 4/1994 | Nabors, Jr. et al. | 431/8 |

FOREIGN PATENT DOCUMENTS 474904 3/1915 France .

*Primary Examiner*—Carl D. Price
*Attorney, Agent, or Firm*—William M. Hobby, III

[57] ABSTRACT

A low pressure atomizer is used for the atomization of liquids, such as atomization of fuels found in industrial burners. An atomizer body has an atomizing chamber therein and an annular liquid conduit having an annular diffusion member therein. The diffusion member is shaped to direct liquid passing thereby and into the atomizing chamber and forces the liquid to enter the chamber adjacent the walls thereof. The atomizer body has a first annular gas conduit and a tangential gas port connected between the annular gas conduit and the liquid conduit so that the gas impinges tangentially against the liquid to shear and rotate the liquid entering the atomization chamber. A second annular gas conduit has an angled open into the atomizing chamber to further shear the liquid and gas mixture in the atomizer chamber so that a low pressure atomizer atomizes a liquid with low pressure gas streams. A plurality of tangential gas ports connect the gas conduit to the atomizing chamber with the tangential ports being generally perpendicular to the gas conduit.

12 Claims, 1 Drawing Sheet

LOW PRESSURE ATOMIZER

BACKGROUND OF THE INVENTION

The present invention relates to the atomization of liquids and especially to the atomization of liquids with a low pressure atomizer.

Atomization of liquids is critical to many thermodynamic and chemical reactions, such as found in industrial combustion. With current pollution control requirements and a desire to improve efficiency, industrial users of fossil fuels have often sought the use of oxygen enriched air or pure oxygen in place of air to improve the combustion characteristics of their particular application. Most of these processes use a gaseous fuel but many have a liquid fuel for backup. With the expanded use of oxygen for combustion worldwide, many countries rely mainly on liquid fuels for their sole energy source.

One of the largest expenses of converting to oxygen combustion is the supply of oxygen itself. Oxygen is commonly supplied in a refrigerated liquid form which is a more expensive form of delivery. New technology in the field of air separation has enabled a less costly source of oxygen. These new technologies for oxygen production, although in many instances less expensive, have restrictions not required by older technology. One such restriction is a lower oxygen supply pressure. If a particular installation require pressures higher than can be supplied by the oxygen generation unit, additional equipment, fans or compressors, must be added to meet this requirement. The additional equipment will result in higher operating and capital costs and diminish the gain of the more efficient oxygen generation unit.

Liquid droplet size and distribution determine the reaction rate of the process. A large number of industrial combustion processes rely on two fluid atomization. This type of atomization is typically accomplished by impacting an atomizing media, usually in a gaseous form, with the liquid to be atomized. Two main problems are associated with current atomization technology 1) atomization is performed with compressed air and 2) atomization requires pressures higher than desirable to fully utilize a most efficient oxygen generation process. From an emission point of view, oxides of nitrogen (NOX) are minimized by minimizing nitrogen infiltration into the combustion process. With pure oxygen combustion, almost no discernible nitrogen is supplied by the oxidizer, thus greatly reducing the NOX emissions. If air is used to atomize the liquid fuel, a great amount of nitrogen is introduced into the system. By using oxygen for atomization as well as combustion NOX formed by this nitrogen source will be nearly eliminated. If current higher pressure atomizers are used with oxygen a conflict with supply pressure may result and may require more costly modifications. With an atomizer that has the ability to take advantage of pure oxygen use and low supply pressure the most economical system can be utilized.

Prior art U.S. patents include the Finke patent, U.S. Pat. No. 4,475,885, for an adjustable flame burner for an industrial furnace having a burner body having a baffle with a discharge face forming a forward wall therefor. One set of apertures is formed at an acute angle to a second set of apertures and intersect at the discharge face. The Hebel patent, U.S. Pat. No. 4,997,362, is for a ceramic burner for use in a hot blast oven which has a generally cylindrical wall defining a central burner duct and an annular outer duct disposed coaxially to the central burner duct and which uses first and second ring nozzles extending from the outer duct and the opening at the burner mouth. The Easehack patent, U.S. Pat. No. 4,842,509, is a process for fuel combustion with low NOX soot and particulate emission which have a central supply tube with a surrounding air tube and which provides high velocity air jets injected into a combustion chamber. The Young et al. patent, U.S. Pat. No. 5,044,558, is a burner nozzle with replaceable airjetting assembly while the Delano patent, U.S. Pat. No. 4,988,285, is a reduced NOX combustion method which has a central fuel line with separately injected oxidant lines. The Ho patent, U.S. Pat. No. 4,957,050, is a combustion process having improved temperature distribution with a central fuel injection for the injection of an atomized liquid. The Paret, Jr. patent, U.S. Pat. No. 2,149,980, is a method and apparatus for controlling furnace combustion while the Fioravanti et al. patent, U.S. Pat. No. 4,954,076, is a flame stabilizing oxyfuel recirculating burner which uses a high oxidant velocity and a venturi aspirator and recycled combustion products directed through the burner block into the oxidant stream. The Fischer et al. patent, U.S. Pat. No. 4,933,163, is a process of removing hydrogen sulfide from exhaust gas and has a central feed tube surrounded by a second tube which feeds the gas to the combustion chamber with air supplied through an outer tube. The Leikert et aI. patent, U.S. Pat. No. 4,790,743, is a method of reducing the NOX emissions during combustion which feeds coal dust to a combustion chamber. The Gitman patent, U.S. Pat. No. 4,622,007, is a variable heat generating method and apparatus having angled feed tubes feeding a combustion chamber which is being fed by a central tube. The Anderson patent, U.S. Pat. No. 4,541,796, is an oxygen aspirator burner for firing a furnace which has a plurality of oxidant jets adjacent a central nozzle. The Guillaume et al. patent, U.S. Pat. No. 4,494,923, is an oxy fuel burner having a central feed surrounded by spaced apertures. A second Anderson patent, U.S. Pat. No. 4,378,205, is an oxygen aspirator burner and process for firing a furnace similar to the Anderson patent '796. The Suzuki et al. patent, U.S. Pat. No. 4,439,137, is a method and apparatus for combustion with a minimum of NOX emission having a central fuel feed for a furnace and which injects air for combustion through the burner tile in a pattern asymmetrical with respect to the burner tile or baffle axis. The Kobayashi et al. patent, U.S. Pat. No. 5,267,850, is a fuel jet burner having a high velocity central fuel feed and low velocity annular coaxial oxidant streams for carrying out combustion. The Nabors, et al. patent, U.S. Pat. No. 5,320,112, (by Applicant) is a burner apparatus and a method having independent flow streams, one for an oxidizer and one for a fuel, with adjustable controls to permit various flame configurations.

The present invention is directed towards the atomization of liquids for thermodynamic and chemical reactions, such as found in industrial combustion, and which uses a low pressure atomizer having a central fuel passageway with a diffusion member therein and having annular gas inlets with tangential feeding of the gas into the liquid inlet to shear and rotate the liquid being fed into an atomizer chamber. A second annular gas inlet is fed into the atomizer chamber at an angle to further shear the liquid and gas mixture so that a low pressure atomizer atomizes a liquid with a low pressure gas stream.

SUMMARY OF THE INVENTION

A low pressure atomizer is used for the atomization of liquids, such as atomization of fuels found in industrial burners. An atomizer body has an atomizing chamber therein and an annular liquid conduit having an annular diffusion member therein. The diffusion member is shaped to direct liquid passing thereby and into the atomizing chamber and forces the liquid to enter the chamber adjacent the walls thereof. The atomizer body has a first annular gas conduit and a tangential gas port connected between the annular gas conduit and the liquid conduit so that the gas impinges tangentially against the liquid to shear and rotate the liquid entering the atomization chamber. A second annular gas conduit has an angled open into the atomizing chamber to further shear the liquid and gas mixture in the atomizer chamber so that a low pressure atomizer atomizes a liquid with low pressure gas streams. A plurality of tangential gas ports connect the gas conduit to the atomizing chamber with the tangential ports being generally perpendicular to the gas conduit and atomizing chamber.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
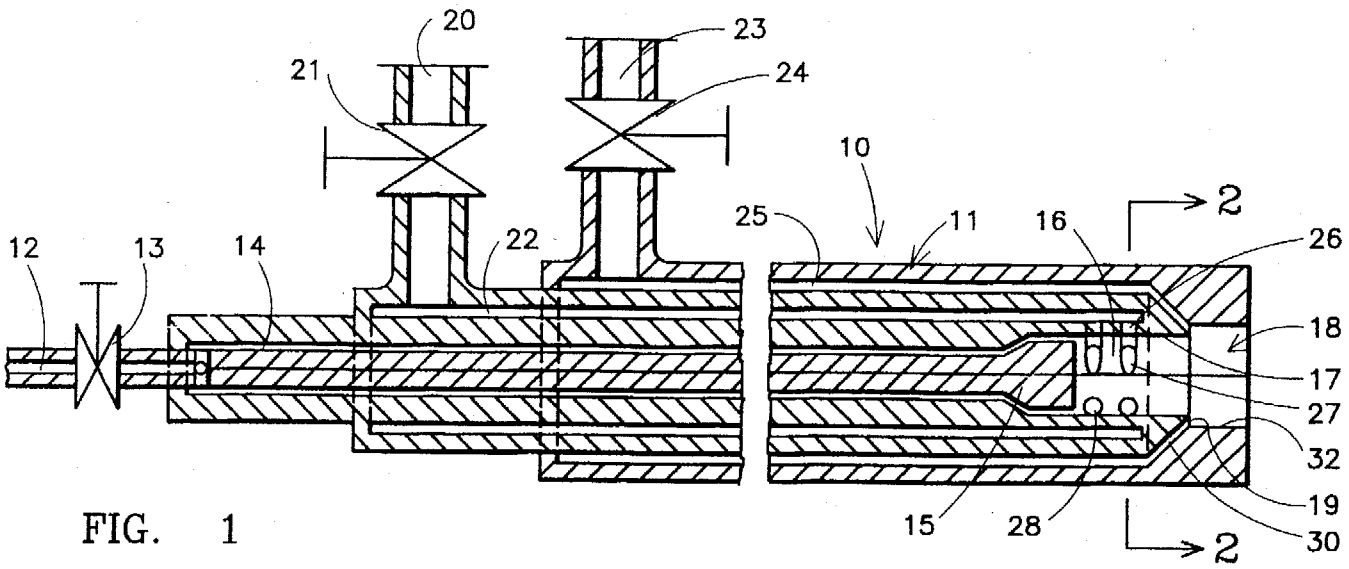
FIG. 1 is a sectional view of a low pressure atomizer in accordance with the present invention.
Figure 3:
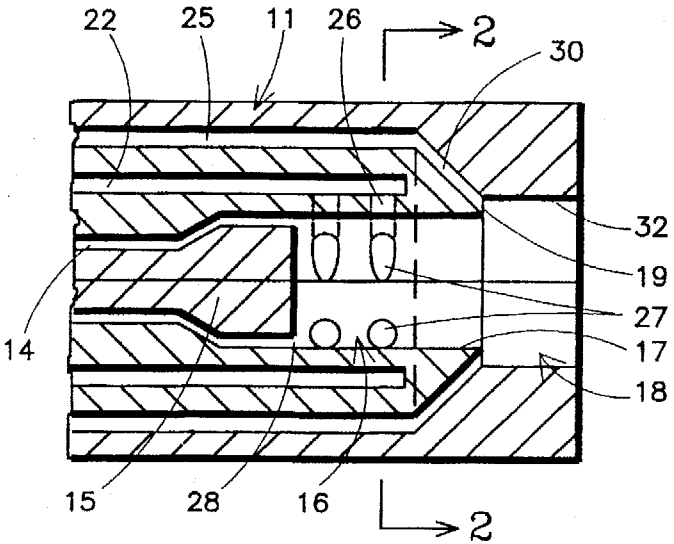
FIG. 3 is a sectional view of the atomizer of FIG. 1 atomizing head.
Figure 2:
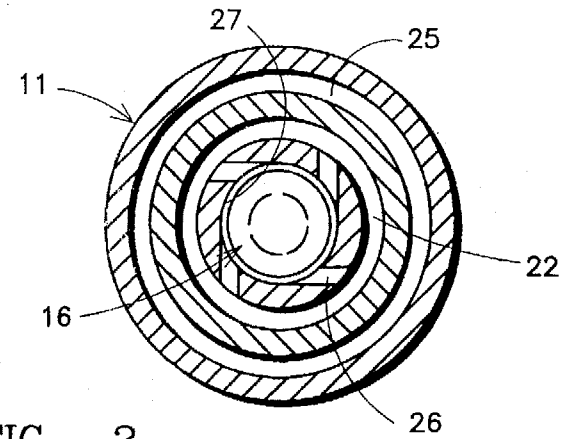
FIG. 2 is a sectional view taken on the line 3—3 of FIG. 1.

Referring to the drawings of FIGS. 1–3, a low pressure atomizer 10 has a body 11 having a liquid feed line 12 which could, for instance, be a fuel for an industrial combustion burner. The liquid in the fuel inlet 12 is controlled by valve 13 and is fed into the atomizer body 11 and into an annular liquid feed conduit 14. The liquid passing through the annular passageway or conduit 14 is forced by a diffusion cone 15 against an atomizing chamber 16 annular wall 17. The atomizing chamber 16 includes an enlarged area 18. A gas line 20 controls a low pressure gas with a valve 21 which feeds into an annular gas feed passageway or conduit 22 while a gas feed line 23 controls a low pressure gas with a valve 24 and feeds into an annular gas conduit 25. The annular or concentric passageway 22 feeds the gas therethrough and out a plurality of passageways 26 which connect the concentric gas passageway 22 with the atomizing chamber 16. The passageways or ports 26 have tangential openings 27 feeding into the atomizing chamber 16 tangentially with the passageways 26 running generally perpendicular to the gas passageway 22 and the atomizing chamber 16. The gas entering the low pressure tangential outlets 27 into the chamber 16 directs a low pressure gas into the liquid stream from the diffusion cone 15 and out the annular outlet 28 along the atomizing chambers interior wall 17 where the low pressure tangential outlets 27 direct the low pressure gas tangentially to rotate and shear the liquid passing along the interior wall 17. This sheared and rotating mixture is now partially atomized into droplets of liquid and feeds into the chamber portion 18.

A second concentric gas passageway 25 feeds a low pressure gas into the annular atomizing gas passageways 30 which are angled into the atomizing chamber enlarged area 18 and open thereinto with the circumferential gas outlets 19 where the partially atomized liquid and gas mixture is further sheared to complete the atomization of the low pressure liquid with low pressure gas feeds. The circumferential gas outlets 19 feeding into the partially atomized liquid prevents centrifugal force created by the tangential atomization of the gas exiting the outlets 27 from forcing the liquid droplets already created against the atomizing chamber exterior wall 32 since that is when the liquid partially atomized, passes from the atomization chamber 16 to the atomization chamber portion 18. The partially atomized liquid is directed away from the walls to prevent droplet conglomeration and reduce the efficiency of the atomizer.

The atomizer, in accordance with the drawings, has been found to operate as low as 40 iwcg of atomizing pressure of oxygen/fuel oil application. Because of the low atomization pressure, liquids to be atomized can be supplied at pressures below atomization and the atomizer will also work well with high pressure, in which case an extremely fine atomized liquid is produced. The atomizer, in accordance with the present invention, uses a higher percentage of atomizing gas than other atomizers but, at the same time, the low atomization pressure saves energy while flow rates of atomizing gas are higher than for other atomizers so that a blower can be used in place of a compressor to create the lower pressures.

Referring to the atomizer body 11, the circumferential or annular atomizing gas passageway 30 is illustrated entering the atomization chamber portion 18 at a 45 degree angle. It should be clear that the angle can be varied between parallel and perpendicular to produce a variety of different atomization results. The atomization chamber wall 32 diameter is larger than the atomizer interior wall 17 diameter to prevent high pressures and to better disperse the droplets of liquid and which with the outlets 19, prevent a centrifugal force to force the liquid droplets from the surface of the walls of the atomization chamber.

As illustrated in FIG. 2, one set of tangential passageways 26 and outlets 27 is illustrated as having four outlets 27 and, since two sets are used in FIG. 1, there are eight outlets 27 but it will, of course, be clear that any number of outlets or ports can be used without departing from the spirit and scope of the invention.

It should be clear at this time that a low pressure atomizer for atomizing liquids, such as used in combustion processes, has been provided. However, it should also be clear that the present invention is not to be limited to the forms shown which are to be considered illustrative rather than restrictive.

I claim:

1. A low pressure atomizer comprising:

an atomizer body having an atomizer chamber formed therein with interior walls;

an annular liquid conduit formed in said atomizer body;

an annular diffusion member formed in said liquid conduit and shaped to direct liquid passing thereby into said atomizer chamber adjacent said atomizer chamber interior walls;

a first annular gas conduit formed in said atomizer body;

at least one tangential gas port connecting said first annular gas conduit to said atomizing conduit to sheer and rotate said liquid passing adjacent the interior walls of said atomizing chamber to form a liquid gas mixture;

a second annular gas conduit having an angled annular opening into said atomizer chamber to further sheer said liquid gas mixture whereby a low pressure atomizer atomizes a liquid with a low pressure gas.

2. A low pressure atomizer in accordance with claim 1 in which said annular diffusion member expands the annular liquid conduit to thereby introduce said liquid into said atomizing chamber along the interior walls thereof.

3. A low pressure atomizer in accordance with claim 2 in which said second annular gas conduit angled annular opening has a reduced annular opening to feed a gas into the atomizer chamber at an angle.

4. A low pressure atomizer in accordance with claim 2 having a plurality of tangential gas ports feeding gas between said gas first gas conduit and said atomizer chamber.

5. A low pressure atomizer in accordance with claim 4 in which said plurality of tangential gas ports are formed with two sets of tangential gas ports.

6. A low pressure atomizer in accordance with claim 5 in which there are two sets of 4 tangential gas ports.

7. A low pressure atomizer in accordance with claim 4 in which said tangential gas ports are generally perpendicular to said first annular gas conduit and to the interior walls of said atomizer chamber.

8. A low pressure atomizer in accordance with claim 4 in which said first and second annular gas conduits each have a control valve for separately controlling the gas fed thereinto.

9. A low pressure atomizer in accordance with claim 8 in which said annular liquid conduit has a liquid valve for controlling flow of liquid therethrough.

10. A low pressure atomizer in accordance with claim 1 in which said annular liquid conduit is a combustion fuel conduit and said first and second annular gas conduits are each an oxidant conduit whereby said low pressure atomizer creates a combustible mixture.

11. A low pressure atomizer in accordance with claim 1 in which said atomizer body atomizer chamber has a first generally cylindrical chamber portion and a second general cylindrical chamber portion of a larger diameter than said first atomizer chamber portion.

12. A low pressure atomizer in accordance with claim 11 in which said second annular gas conduit angled annular opening opens into said second atomizer chamber portion adjacent the said first atomizer chamber portion to thereby direct liquid away from the interior wall of said second atomizer chamber portion.

* * * * *